US009016885B2

(12) United States Patent
Kempfle et al.

(10) Patent No.: US 9,016,885 B2
(45) Date of Patent: Apr. 28, 2015

(54) REFRIGERATOR HAVING AN INTERNAL LIGHTING SYSTEM

(75) Inventors: Stephan Kempfle, Ellzee (DE); Michael Roth, Haunsheim (DE); Matthias Wiedenmann, Neenstetten (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 13/812,526

(22) PCT Filed: Aug. 8, 2011

(86) PCT No.: PCT/EP2011/063612

§ 371 (c)(1),
(2), (4) Date: Jan. 28, 2013

(87) PCT Pub. No.: WO2012/022647

PCT Pub. Date: Feb. 23, 2012

(65) Prior Publication Data

US 2013/0120966 A1 May 16, 2013

(30) Foreign Application Priority Data

Aug. 20, 2010 (DE) ..... 10 2010 039 574

(51) Int. Cl.
*F21V 33/00* (2006.01)
*F25D 27/00* (2006.01)
(Continued)

(52) U.S. Cl.
CPC ..... *F25D 27/00* (2013.01); *F25D 2400/40* (2013.01); *F21V 33/0044* (2013.01); *F21V 23/06* (2013.01); *F21W 2131/305* (2013.01)

(58) Field of Classification Search
CPC ..... F21V 23/06; F21V 33/0044; F21W 2131/305; F25D 27/00; F25D 2400/40
USPC ..... 362/92–94, 155; 62/264
See application file for complete search history.

(56) References Cited

U.S. PATENT DOCUMENTS 5,016,146 A * 5/1991 Kaspar ..... 362/92
2004/0011678 A1* 1/2004 Ramet ..... 206/216
(Continued)

FOREIGN PATENT DOCUMENTS

CN 101418934 A 4/2009
CN 101688726 A 3/2010
(Continued)

OTHER PUBLICATIONS

International Search Report PCT/EP2011/063612 dated Feb. 14, 2012.

*Primary Examiner* — Jason Moon Han
(74) *Attorney, Agent, or Firm* — Nixon & Vanderhye P.C.

(57) ABSTRACT

A refrigerator includes a thermally insulating internal container having an interior space, a refrigeration apparatus for cooling the interior space, and a door leaf arranged pivotably relative to the internal container for opening and closing the interior space. Arranged within the interior space is an internal lighting system for at least partially illuminating the interior space. The lighting system includes a conductor board having an electrical contact, a housing having a shaft which is open in a direction toward the interior space so as to allow the conductor board to be pushed into the shaft, and a lighting member arranged within the housing and fastened on the conductor board. An electrical line supplies electrical energy to the lighting member and is provided with an edge board plug which is electrically connected to the electrical contact of the conductor board for connecting the lighting member electrically to the electrical line.

18 Claims, 2 Drawing Sheets

(51) Int. Cl.

| | |
|---|---|
| ***F27D 21/02*** | (2006.01) |
| ***F21V 23/06*** | (2006.01) |
| *F21W 131/305* | (2006.01) |

(56) References Cited

U.S. PATENT DOCUMENTS

| | | | | |
|---|---|---|---|---|
| 2008/0219002 | A1* | 9/2008 | Sommers et al. | 362/247 |
| 2009/0103291 | A1 | 4/2009 | Jarzac | |
| 2009/0200966 | A1* | 8/2009 | Whitehouse et al. | 315/309 |
| 2010/0103672 | A1* | 4/2010 | Thomas et al. | 362/235 |
| 2010/0220460 | A1* | 9/2010 | Hall | 362/92 |

FOREIGN PATENT DOCUMENTS

| | | | |
|---|---|---|---|
| DE | 19504112 | A1 | 8/1996 |
| GB | 2467027 | A | 7/2010 |

* cited by examiner

REFRIGERATOR HAVING AN INTERNAL LIGHTING SYSTEM

BACKGROUND OF THE INVENTION

This application is a U.S. National Phase of International Patent Application No. PCT/EP2011/063612, filed Aug. 8, 2011, which designates the U.S. and claims priority to German Patent Application No. DE 10 2010 039 574.9, filed Aug. 20, 2010, the entire contents of each are hereby incorporated herein by reference.

Conventional domestic refrigerators usually have a thermally insulating internal container with an interior space which can be cooled, a refrigeration apparatus for cooling the interior space and a door leaf which is arranged pivotably relative to the internal container for opening and closing the interior space. Normally, an internal lighting system is provided which at least partially illuminates the interior space when the door leaf is open. When the door leaf is closed, the internal lighting system is switched off.

BRIEF SUMMARY OF THE INVENTION

It is an object of the invention to provide an improved refrigerator, in particular an improved domestic refrigerator with an internal lighting system.

The aim of the invention is achieved with a refrigerator comprising a thermally insulating internal container with an interior space which can be cooled, a refrigeration apparatus for cooling the interior space and a door leaf which is arranged pivotably relative to the internal container for opening and closing the interior space and an internal lighting system which is arranged within the interior space for at least partial illumination of the interior space, and comprising a housing and a lighting means which is arranged within the housing and can be supplied with electrical energy by means of an electrical line, wherein the end of the electrical line facing toward the internal lighting system is provided with an edge board plug for electrically contacting the lighting means. The refrigerator according to the invention is, in particular, a domestic refrigerator, for example a domestic cooling device or a fridge-freezer combination.

The refrigerator according to the invention therefore includes the internal lighting system for at least partial illumination of the coolable interior space. In order to connect the lighting means of the internal lighting system which is configured, for example, as at least one LED, to the electrical line for supplying the lighting means with electrical energy, said electrical line comprises the edge board plug. An edge board plug is a plug which is relatively simple and economical to implement which can be plugged in, in particular, for contacting a conductor board or printed circuit board at the edge region thereof. The lighting means can also comprise a plurality of LEDs of which at least two of the LEDs can have different colors.

According to a preferred embodiment of the refrigerator according to the invention, the internal lighting system thereof comprises a conductor board to which the lighting means is fastened and comprises an electrical contact which is electrically connected to the edge board plug in order to connect the lighting means to the electrical line. The electrical contact is arranged at an edge region of the conductor board.

The housing of the internal lighting system can be foam-filled with a thermally insulating material of the internal container. In a relatively simple manner, therefore, the lighting means can be arranged within the housing of the internal lighting system, thus reducing the assembly effort.

According to a preferred embodiment of the refrigerator according to the invention, the housing of the internal lighting system comprises a shaft into which the conductor board is plugged with the lighting means. Said shaft can be open in the direction facing the interior space in order, for example, to be able to exchange a defective lighting means relatively easily.

The edge board plug can be plugged into the shaft in order to be electrically connected to the contact of the conductor board. In order to obtain good fastening of the edge board plug, said plug can be plugged in form-fitting manner into the shaft.

The shaft can comprise an opening into which the edge board plug is inserted at the end facing the thermally insulating material.

The internal lighting system can comprise a cover or a cap for covering the edge board plug. In particular, if the edge board plug is able to come into contact with an insulating foam of the refrigerator, a cap of this type can seal the edge board plug against the insulating foam. The cap is made, for example, of plastics.

The cap can preferably be configured as a film hinge. The film hinge or cap can be configured as a separate individual part or preferably in one piece on the housing of the internal lighting system.

The cap can be latched to the edge board plug for fastening.

The refrigerator according to the invention also comprises, depending on the embodiment, an LED housing with electrical contacts. For contacting the lighting means, possibly of the LED board or the LED conductor board, a direct plug connector, an "edge board plug" is used. For sealing relative to the exterior, a cap made, for example, of plastics is used which can be made as a film hinge connection, in particular, to the housing of the internal lighting system or as a separate individual part.

The refrigerator according to the invention makes possible an improved installation of the internal lighting system by laying the cable (electrical line) in a defined manner. A relatively compact construction is possible since the electrical line (cable outlet) can be routed along the housing of the internal lighting system, configured, for example, as a backing piece.

The use of the edge board plug creates the possibility of installing plug connections with high pole numbers for contacting the board which is possibly used, and possibly individual control of LEDs for different colors of light.

A relatively simple (rectangular) board geometry can be used.

A cost saving can be achieved by reducing the part count and using standard plug connectors.

Complex rubber encapsulation for the housing of the internal lighting system is not necessary.

The cap used for sealing can possibly be made of a material with a higher incandescent wire resistance than the rubber encapsulation. The result is that a stronger electrical current can be allowed to flow via the connection to the board.

Simplification of assembly can be achieved by means of a more favorable direction of insertion of the board into the housing. The creation of the electrical connection is not achieved by blind insertion of pin into socket, but can be carried out by pushing the board into the edge board connector via guides integrated into the housing.

BRIEF DESCRIPTION OF THE DRAWINGS

An exemplary embodiment of the invention is shown in the accompanying schematic drawings, in which.

DETAILED DESCRIPTION OF EXEMPLARY EMBODIMENTS OF THE PRESENT INVENTION

Figure 1:
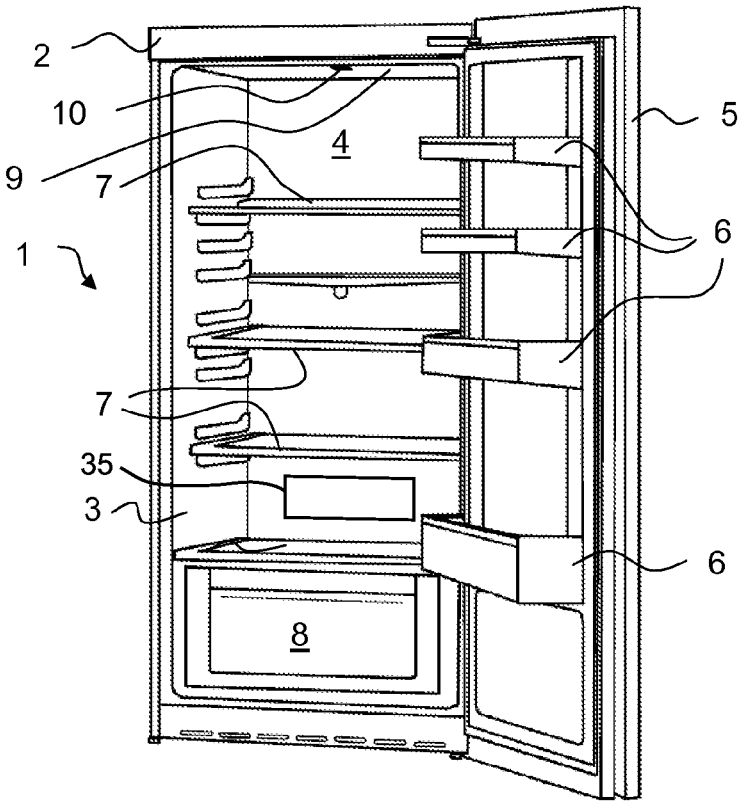
FIG. 1 is a domestic refrigerator with an internal lighting system.

FIG. 1 shows a domestic refrigerator 1 as an example of a refrigerator. The domestic refrigerator 1 which is configured, for example, as a no-frost apparatus has a carcase or a housing 2 and a thermally insulating internal container 3 having an interior space 4 which can be cooled. The domestic refrigerator 1 is, for example, a domestic cooling device.

The domestic refrigerator 1 also comprises a refrigerating apparatus 35 which is not described in detail, but is known in principle to a person skilled in the art and which is provided for cooling the interior space 4 and is controlled by a control device (not described in detail), so that the interior space 4 has, at least approximately, a target temperature which is set in advance. The refrigerating apparatus 35 comprises, for example, a refrigerating circuit which has, for example, an evaporator, a condenser, etc.

The domestic refrigerator 1 comprises a door leaf 5 mounted on the housing 2 by means of hinges for closing the interior space 4. With the door leaf 5 open, the interior space 4 is accessible. In the case of the present exemplary embodiment, a plurality of door shelves 6 is arranged at the side of the leaf 5 of the door provided for closing the interior space, which faces the interior space 4.

In the case of the present exemplary embodiment, a plurality of shelves 7 is arranged over one another in the interior 4 for storing goods to be cooled and, in the lower region of the interior space 4, a drawer 8 is provided which can be at least partially pulled out of the interior space 4.

Figure 2:
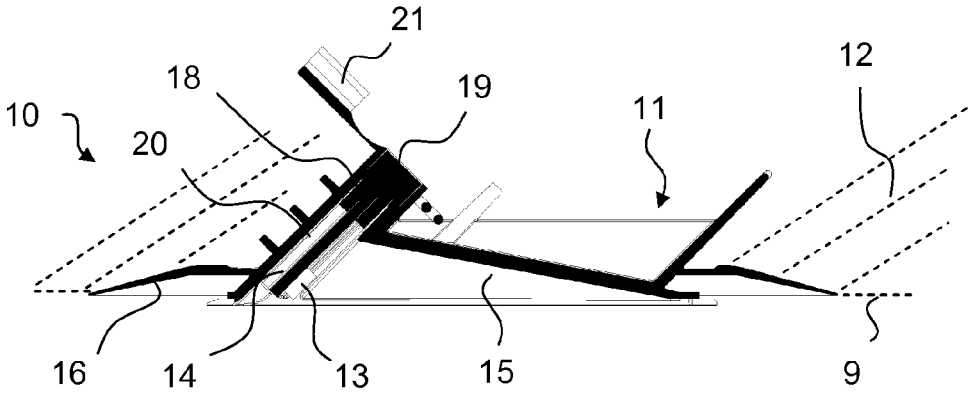
FIG. 2 is a side view of the internal lighting system in a sectional representation.
Figure 3:
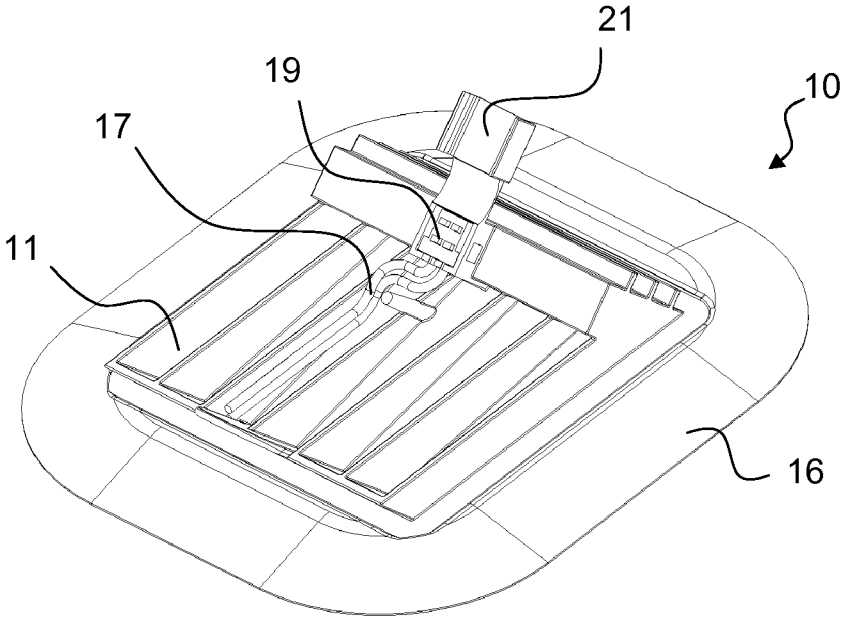
FIGS. 3, 4 are perspective views of the internal lighting system.
Figure 4:
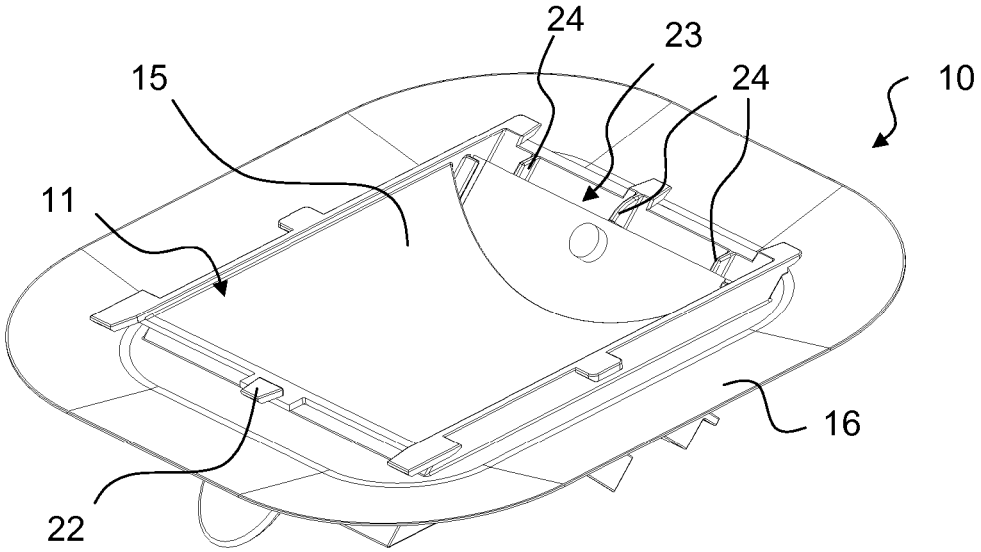

In the case of the present exemplary embodiment, when the door leaf 5 is open, the interior space 4 is at least partially illuminated by means of the internal lighting system 10 shown in FIGS. 2 to 4.

In the case of the present exemplary embodiment, the internal lighting system 10 has a housing 11 which is embedded, for example, in the cover 9 or in one of the side walls of the internal container 3 in a thermally insulating material, in particular an insulating foam 12 and has been made, for example, of plastics material in an injection molding process. FIG. 2 shows a lateral view of the internal lighting system 10 in a sectional representation and FIGS. 3 and 4 show the internal lighting system 10, in particular the housing 11 thereof, in a perspective representation, wherein FIG. 3 shows the side embedded in insulating foam 12 and FIG. 4 shows the side of the housing 11 of the internal lighting system 10 which faces the interior space 3.

The internal lighting system 10 comprises as the lighting means, for example, at least one LED 13 which is fastened, for example, to a circuit board or a conductor board 14. The LED 13 or the conductor board 14 are inserted, for example, into a shaft 20 of the housing 11 which, in the case of the present exemplary embodiment, is open both in the direction toward the insulating foam 12 and in the direction toward the interior space 3. The housing 11 comprises, for example, a reflector 15 in order at least partially to reflect the light originating from the LED 13, so as to illuminate the interior space 4 better therewith. A plurality of LEDs 13 can also be provided, of which at least two of the LEDs have different colors.

The shaft 20 is open in the direction toward the interior space 3 and comprises, in said region, an opening 23 through which the conductor board 14 with the LED 13 can be inserted into the shaft 20. Furthermore, the shaft 20 has, for example, guides 24 for the conductor board 14.

In order to seal the housing 11 better against the insulating foam 12, in the case of the present exemplary embodiment, the housing 11 has, for example, a sealing lip 16 which is molded integrally onto the housing 11.

In the case of the present exemplary embodiment, an electrical line 17 which is provided to supply the LED 13 when the door leaf 5 is open extends within the insulating foam 12. The electrical line 17 is connected, for example, with one end thereof to the control device of the domestic refrigerator 1 so that the internal lighting system 10 is switched on when the door leaf 5 is open and, with the door leaf 5 closed, is switched off.

In order to connect the electrical line 17 to the LED 13 or to the conductor board 14, the conductor board 14 comprises an electrical contact 18 at the edge region thereof. The end of the electrical line 17 facing toward the internal lighting system 10 is provided with an edge board plug 19 which is plugged, particularly, in form-fitting manner, into the shaft 20 of the housing 11 and thus makes electrical contact with the contact 18 of the conductor board 14. The edge board plug 19 is plugged, in form-fitting manner, particularly into an opening of the shaft 20 which faces in the direction of the insulating foam 12.

In order to seal the shaft 20 better against the insulating foam 12, in the case of the present exemplary embodiment, a further cap is provided made, for example, of plastics and/or in the form of a film hinge 21, which is shown in FIGS. 2 and 3 in the folded open state. Following contacting of the edge board plug 19 to the conductor board 14 and before embedding of the housing 11 into the insulating foam 12, the film hinge 21 is folded open in order to close the end of the shaft 20 in which the edge board plug 19 is received in form-fitting manner. The film hinge 21 is molded, for example, integrally onto the housing 11, as shown in FIGS. 2 and 3.

The internal lighting system 10 also comprises an at least semi-transparent cover (not shown in detail) with which the reflector 15 can be closed. The cover can be, for example, clipped onto or locked to the inner container 3 or the housing 11 of the internal lighting system 10. The cover can also be releasably fastened to the housing 11 of the internal lighting system 10 or to the internal container 3. The housing 11 comprises, for example, integrally molded-on locking means 22 so that the cover can be fastened to the housing 11.

The invention claimed is:

1. A refrigerator, comprising:

a thermally insulating internal container having an interior space;

a refrigeration apparatus for cooling the interior space;

a door leaf arranged pivotably relative to the internal container for opening and closing the interior space;

an internal lighting system arranged within the interior space for at least partially illuminating the interior space, said lighting system including a conductor board having an electrical contact, a housing having a shaft which is open in a direction toward the interior space so as to allow the conductor board to be inserted into the shaft for assembly of the internal lighting system, and a lighting member arranged within the housing and fastened on the conductor board; and an electrical line for supply of electrical energy to the lighting member, said electrical line having an end which faces toward the internal lighting system and is provided with an edge board plug which is configured to be electrically connected to the electrical contact of the conductor board for connecting the lighting member electrically to the electrical line, wherein the shaft has a first opening and the edge board plug is configured to be inserted into the first opening for removable electrical connection with the electrical contact of the conductor board, and wherein the shaft forms a passageway having a second opening through which the conductor board passes when inserted into the shaft, and wherein the shaft comprises guides configured to guide the conductor board as the conductor board is inserted into the shaft.

2. The refrigerator of claim 1, constructed in the form of a domestic refrigerator.

3. The refrigerator of claim 1, wherein the lighting member is configured as at least one LED.

4. The refrigerator of claim 1, wherein the lighting member is configured as a plurality of LEDs, at least two of the plurality of LEDs having different colors.

5. The refrigerator of claim 1, wherein the housing of the internal lighting system is embedded in a thermally insulating material of the internal container.

6. The refrigerator of claim 1, wherein the edge board plug is configured to be inserted in the first opening of the shaft in a form-fitting manner.

7. The refrigerator of claim 1, wherein the internal lighting system comprises a cap for covering the edge board plug.

8. The refrigerator of claim 7, wherein the cap comprises plastics.

9. The refrigerator of claim 7, wherein the cap is configured as a film hinge and is secured in at least one of two ways, a first way in which the cap is molded integrally onto the housing of the internal lighting system, a second way in which the cap is locked to the edge board plug.

10. A refrigerator, comprising:

a thermally insulating internal container having an interior space;

a refrigeration apparatus for cooling the interior space;

a door leaf arranged pivotably relative to the internal container for opening and closing the interior space;

an internal lighting system arranged within the interior space for at least partially illuminating the interior space, said lighting system including a conductor board having an electrical contact, a housing having a shaft which is open in a direction toward the interior space so as to allow the conductor board to be inserted into the shaft for assembly of the internal lighting system, and a lighting member arranged within the housing and fastened on the conductor board; and an electrical line for supply of electrical energy to the lighting member, said electrical line having an end which faces toward the internal lighting system and is provided with an edge board plug which is configured to be electrically connected to the electrical contact of the conductor board for connecting the lighting member electrically to the electrical line, wherein the shaft has a first opening, and wherein the edge board plug is configured to be detachably coupled to the shaft such that the edge board plug is configured to be disposed in 1) an inserted position in which the edge board plug is inserted into the first opening and in electrical connection with the electrical contact of the conductor board and 2) a removed position in which the edge board plug is not inserted into the first opening and is not in electrical connection with the electrical contact of the conductor board, and wherein the shaft forms a passageway having a second opening' through which the conductor board passes when inserted into the shaft, and wherein the shaft comprises guides configured to guide the conductor board as the conductor board is inserted into the shaft.

11. The refrigerator of claim 10, constructed in the form of a domestic refrigerator.

12. The refrigerator of claim 10, wherein the lighting member is configured as at least one LED.

13. The refrigerator of claim 10, wherein the lighting member is configured as a plurality of LEDs, at least two of the plurality of LEDs having different colors.

14. The refrigerator of claim 10, wherein the housing of the internal lighting system is embedded in a thermally insulating material of the internal container.

15. The refrigerator of claim 10, wherein the edge board plug is configured to be inserted in the first opening of the shaft in a form-fitting manner.

16. The refrigerator of claim 10, wherein the internal lighting system comprises a cap for covering the edge board plug.

17. The refrigerator of claim 16, wherein the cap comprises plastics.

18. The refrigerator of claim 16, wherein the cap is configured as a film hinge and is secured in at least one of two ways, a first way in which the cap is molded integrally onto the housing of the internal lighting system, a second way in which the cap is locked to the edge board plug.

* * * * *

UNITED STATES PATENT AND TRADEMARK OFFICE

CERTIFICATE OF CORRECTION

PATENT NO. : 9,016,885 B2
APPLICATION NO. : 13/812526
DATED : April 28, 2015
INVENTOR(S) : Kempfle et al.

It is certified that error appears in the above-identified patent and that said Letters Patent is hereby corrected as shown below:

In the claims:

In claim 10 at column 6, line 11, "wherein the shaft has a first opening, and" should be corrected to ---wherein the shaft has a first opening,---

In claim 10 at column 6, line 21, "opening' through which the conductor board passes" should be corrected to ---opening through which the conductor board passes---

Signed and Sealed this
Eighteenth Day of August, 2015

Michelle K. Lee

Michelle K. Lee
*Director of the United States Patent and Trademark Office*